US010865977B1

(12) United States Patent
Lan et al.

(10) Patent No.: US 10,865,977 B1
(45) Date of Patent: Dec. 15, 2020

(54) HEAT DISSIPATION DEVICE AND HIGH-POWER ELECTRIC LIGHT SOURCE

(71) Applicant: SHENZHEN GUANKE TECHNOLOGIES CO., LTD, Shenzhen (CN)

(72) Inventors: Qing Lan, Shenzhen (CN); Tianlong Dai, Shenzhen (CN); Ligen Liu, Shenzhen (CN); Shoubao Chen, Shenzhen (CN); Wenhao Lin, Shenzhen (CN)

(73) Assignee: SHENZHEN GUANKE TECHNOLOGIES CO., LTD, Shenzhen (CN)

( * ) Notice: Subject to any disclaimer, the term of this patent is extended or adjusted under 35 U.S.C. 154(b) by 0 days.

(21) Appl. No.: 16/713,386

(22) Filed: Dec. 13, 2019

(30) Foreign Application Priority Data

Oct. 25, 2019 (CN) ..... 2019 1 1024840

(51) Int. Cl.
*F21V 29/76* (2015.01)
*F21V 29/67* (2015.01)
*F21Y 115/10* (2016.01)

(52) U.S. Cl.
CPC ..... *F21V 29/763* (2015.01); *F21V 29/677* (2015.01); *F21Y 2115/10* (2016.08)

(58) Field of Classification Search
CPC ..... F21V 29/763; F21V 29/677
USPC ..... 362/294
See application file for complete search history.

(56) References Cited

U.S. PATENT DOCUMENTS 5,404,283 A * 4/1995 Yantz ..... F21V 11/18 362/267
7,440,280 B2 * 10/2008 Shuy ..... F28D 15/0233 361/701
7,841,753 B2 * 11/2010 Liu ..... F21K 9/00 362/373
2005/0111234 A1 * 5/2005 Martin ..... F21S 8/026 362/555
2005/0279949 A1 * 12/2005 Oldham ..... G05D 23/20 250/458.1
2009/0168431 A1 * 7/2009 Hsu ..... G02B 6/0085 362/294
2009/0244901 A1 * 10/2009 Hu ..... F21V 29/83 362/294
2010/0061109 A1 * 3/2010 Hou ..... F21V 29/763 362/373

(Continued)

*Primary Examiner* — Bryon T Gyllstrom
(74) *Attorney, Agent, or Firm* — Maier & Maier, PLLC

(57) ABSTRACT

A heat dissipation device and high-power electric light source. The heat dissipation device includes a main radiator and a radiator fan; the main radiator includes a heat dissipation body and a heat dissipation mechanism. The heat dissipation body has a mounting surface and a junction surface. The heat dissipation mechanism includes a number of radiating fins mounted on the junction surface which extend substantially in the left-right direction at intervals and collectively form a heat dissipation channel extending in the left-right direction. The heat dissipation mechanism is provided with a first avoidance space, in which the junction surface has a center line perpendicular to the extension direction of the radiating fin, and the left and right parts of the main radiator bounded by the center line have the same heat dissipation capacity in the natural state.

21 Claims, 11 Drawing Sheets

(56) References Cited

U.S. PATENT DOCUMENTS

| | | | | |
|---|---|---|---|---|
| 2011/0037367 | A1* | 2/2011 | Wang | F21K 9/232<br>313/46 |
| 2013/0135868 | A1* | 5/2013 | Xue | F21V 29/677<br>362/249.02 |

* cited by examiner

HEAT DISSIPATION DEVICE AND HIGH-POWER ELECTRIC LIGHT SOURCE

CROSS-REFERENCE TO RELATED APPLICATIONS

This application claims the priority of Chinese Patent Application No. 201911024840.0 filed on Oct. 25, 2019, the disclosure of which is incorporated herein by reference.

TECHNICAL FIELD

The present invention belongs to the field of lighting lamps, and in particular relates to a heat dissipation device and a high-power electric light source.

BACKGROUND

The high-power LED electric light source is commonly used for replacing the traditional HID light source (high-voltage gas discharge light source), and can be directly installed in the conventional Hight Bay lamps (the general name of conventional lamps installed in the ceiling, such as traditional high-shed lamps, industrial mine lamps, etc.). It is convenient to use. The high-power electric light source cannot be designed to a large size because of the size limit, which restricts the heat dissipation capacity of the electric light source. The radiator fan is usually used to improve the heat dissipation performance. Because the luminous mode for the electric light source used in the conventional Hight Bay lamps is usually designed to horizontal downward luminescence, if the heat dissipation is designed according to the conventional fan heat dissipation scheme, a heat dissipation channel that extends downward vertically is usually set up on the downward luminous LED module, and the radiator fan is arranged on the heat dissipation channel. The fan heat dissipation scheme can better discharge the hot air, and then the heat is discharged as soon as possible. However, in this design, the heat dissipation channel needs to occupy a large installation space, resulting in the reduction of the area of the lamp panel on the downward luminous LED module, making the arrangement of LED lamp beads tighter and improving the temperature rise of LED lamp beads. Therefore, it is difficult to increase the power of electric light source.

SUMMARY

The purposes of the present invention are to provide a heat dissipation device and a high-power electric light source, which is designed to solve the technical problem that the power of the existing electric light source cannot be greatly improved.

One purpose of the present invention is to provide a heat dissipation device for the heat dissipation of electric light source, including:

The main radiator consists of a heat dissipation body and a heat dissipation mechanism. The said heat dissipation body has mounting surface and junction surface. The said mounting surface is used to mount the said electric light source. The said heat dissipation mechanism comprises a plurality of radiating fins arranged on the junction surface which extends substantially in the left-right direction at intervals and collectively forms a heat dissipation channel extending in the left-right direction. The said heat dissipation mechanism is provided with a first avoidance space, in which the said junction surface has a center line perpendicular to the extension direction of the said radiating fin, and the left and right parts of the main radiator bounded by the said center line have the same heat dissipation capacity in the natural state, and the said first avoidance space is arranged on the right side of the said center line;

At least one radiator fan is provided that is installed in the said first avoidance space and used for radiating the airflow flowing from left to right in the said heat dissipation channel.

The technical effect of the present invention relative to the prior art:

(1) The heat dissipation device in the present invention sets the radiator fan in the first avoidance space and generates the airflow flowing from left to right in the heat dissipation channel extending from left to right, so that the heat dissipation channel does not occupy the mounting space of the mounting surface. When the electric light source is luminous for the lamp beads, the heat dissipation device is convenient to arrange more lamp beads on the mounting surface, and does not cause heat concentration due to the close arrangement between the lamp beads. The design of setting the radiator fan in the heat dissipation channel that extends from left to right reduces the height of the heat dissipation channel and saves the installation space.

(2) The heat dissipation channel extends in left-right direction. The radiator fan makes the airflow in the heat dissipation channel flow from left to right, thus reducing the heat dissipation interference between radiating fins and radiator fans.

(3) The radiator fan is provided on the right side of center line, thus increasing the heat radiation capacity in the right side, making the overall heat radiation of the main radiator even and further reducing the maximum temperature of the whole system.

(4) Because the overall heat dissipation capacity of the heat dissipation device is enhanced and the available mounting surface area of electric light source is increased, the heat dissipation device can provide high-power electric light source and the same electric light source can work under the higher power.

BRIEF DESCRIPTION OF THE DRAWINGS

To better describe the technical schemes of the present invention embodiment, a brief introduction of drawings to be used in the descriptions of the present invention embodiment or prior art is made hereby. Obviously, the drawings described below are only several embodiments of the present invention. For common technicians in this field, they can obtain other drawings based on these drawings without making additional creative endeavors.

DETAILED DESCRIPTION

Figure 1:
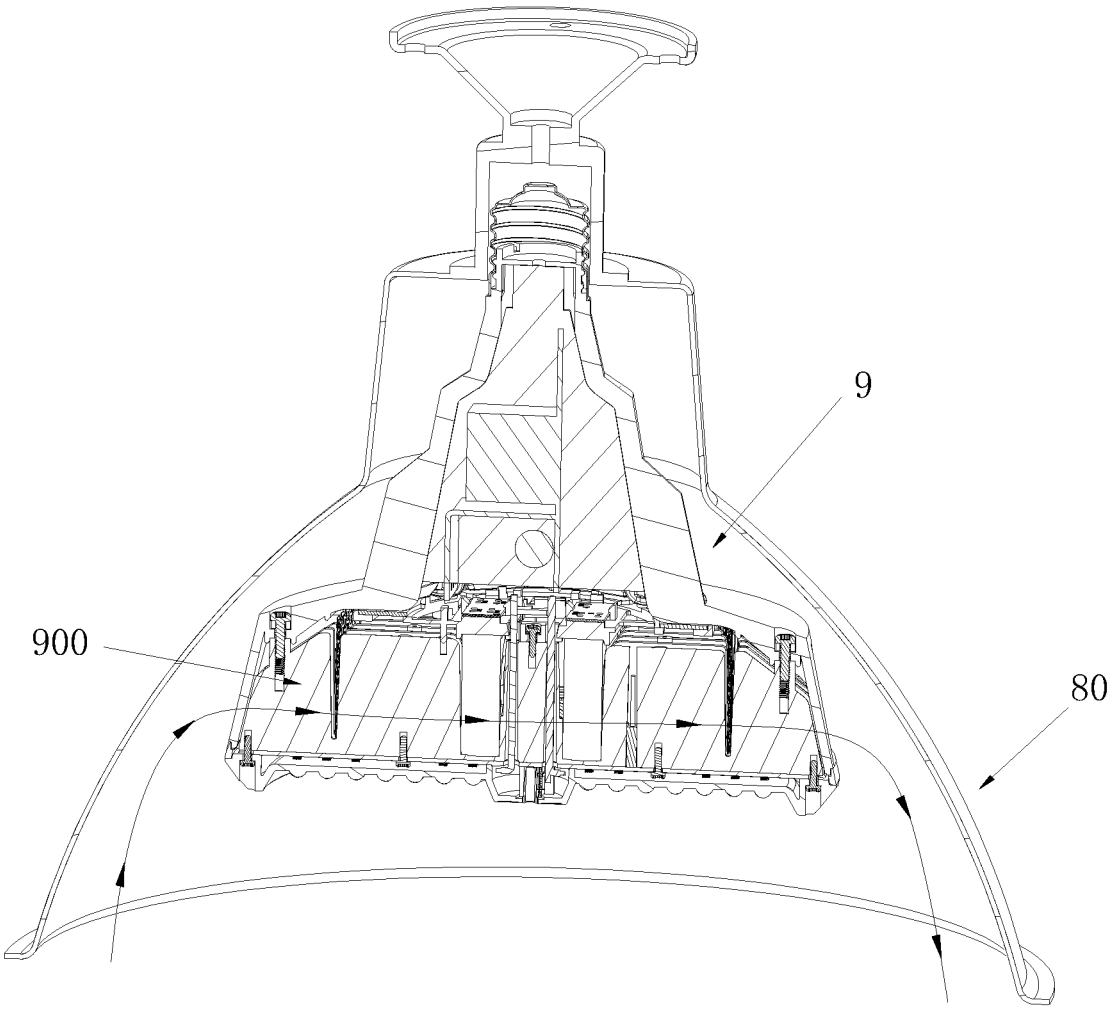
FIG. 1 is the sectional view of working state of the electric light source installed in the traditional Hight Bay lamps, wherein the radiator fan is not drawn.

The following is the detailed description of the embodiment in the present invention. The said embodiments are shown in the drawings, wherein the same or similar mark numbers from the start to the end indicate the same or similar elements or the elements with the same or similar functions. The embodiment described in the drawing is the sample and aims to explain the present invention but cannot be understood as the limit of the present invention.

In order to make the objects, technical schemes and advantages of the present invention more comprehensible, the present invention will be further described in detail below with reference to the drawings and embodiments.

As shown in FIG. 1, the electric light source 9 is installed in the traditional Hight Bay lamps 80 to replace the traditional light source, such as high-power high-pressure sodium lamp, metal halide lamp and so on. Due to the fixed size of traditional Hight Bay lamps 80, the size of electric light source 9 cannot be designed very large. We use one of the semi-open traditional Hight Bay lamps 80 with an open diameter of about 400 mm to do the design analysis and test.

Figure 2:
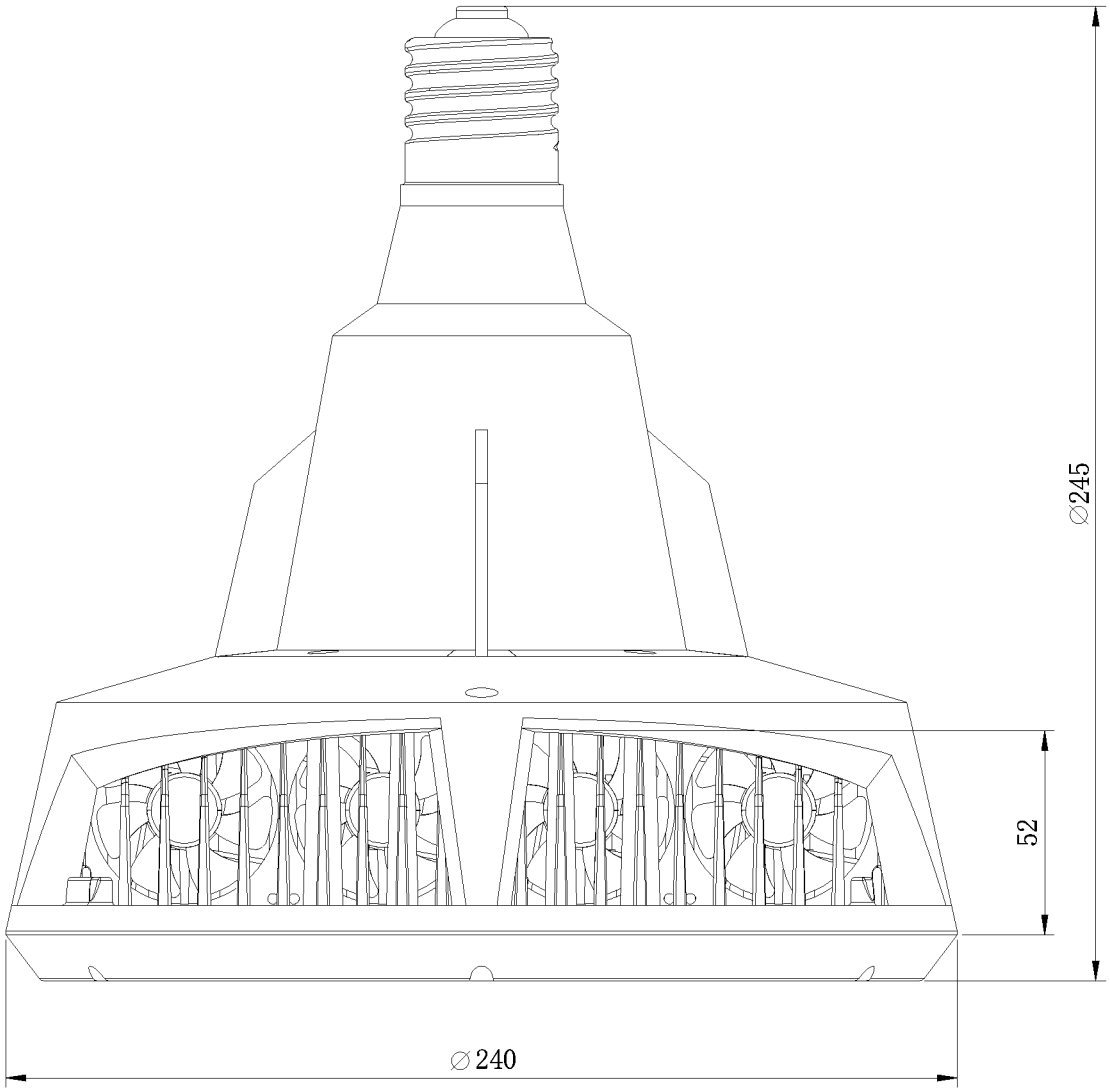
FIG. 2 is the front view of electric light source.

As shown in FIG. 2, the size of the electric light source 9 suitable for the above lamp can be designed to be approximately 240*245 mm, and the size of the heat dissipation device 900 for providing heat to the electric light source 9 can be designed to be approximately 240*52 mm. The power of the electric light source 9, which is approximately this size, is about 150 W-200 W, and the power of the electric light source in the proposed new scheme is 350 W.

Because the size of heat dissipation device 900 is 0240*52 MM, if we select the large-volume fan with Taiwan SUNON model MF50152VX-1000C-A99 (specifications: size 50*50*15 mm; voltage 12 Vdc; current 110 mA; power 1.32 W; rotating speed 7200 RPM; air capacity 18.6 CFM) as the radiator fan 12 in this scheme, at most four radiator fan 12 can be arranged in a row. Therefore, we take 4 radiator fans 12 as the design basis of this scheme.

Figure 4:
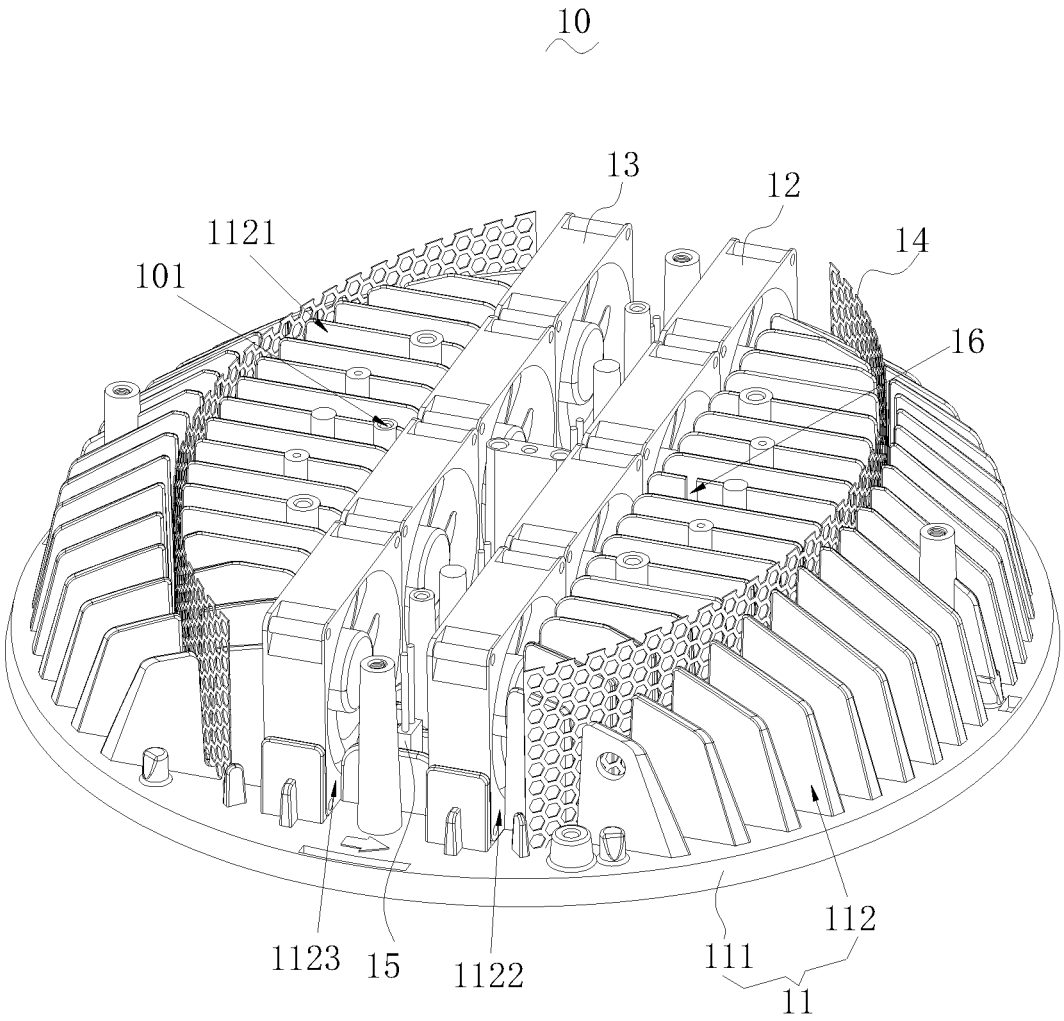
FIG. 4 is the stereoscopic structure diagram of heat dissipation device provided in the embodiment of the present invention.
Figure 5:
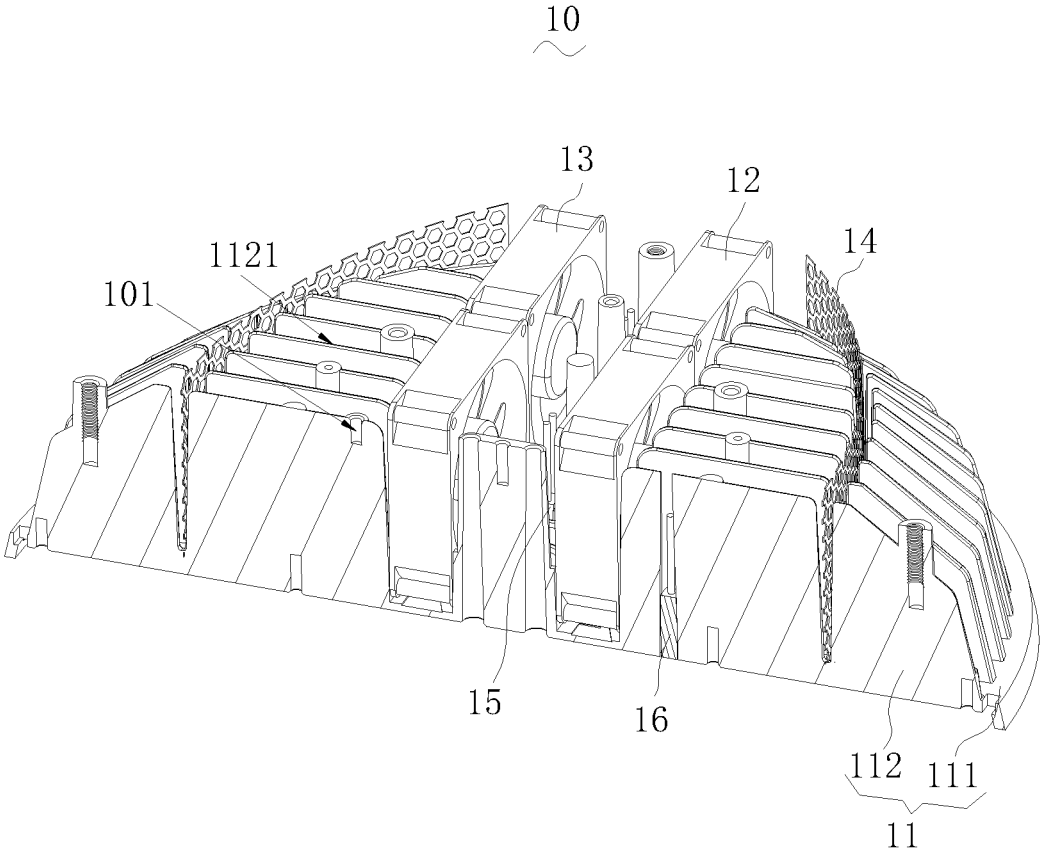
FIG. 5 is the sectional view of heat dissipation device provided in the embodiment of the present invention.
Figure 6:
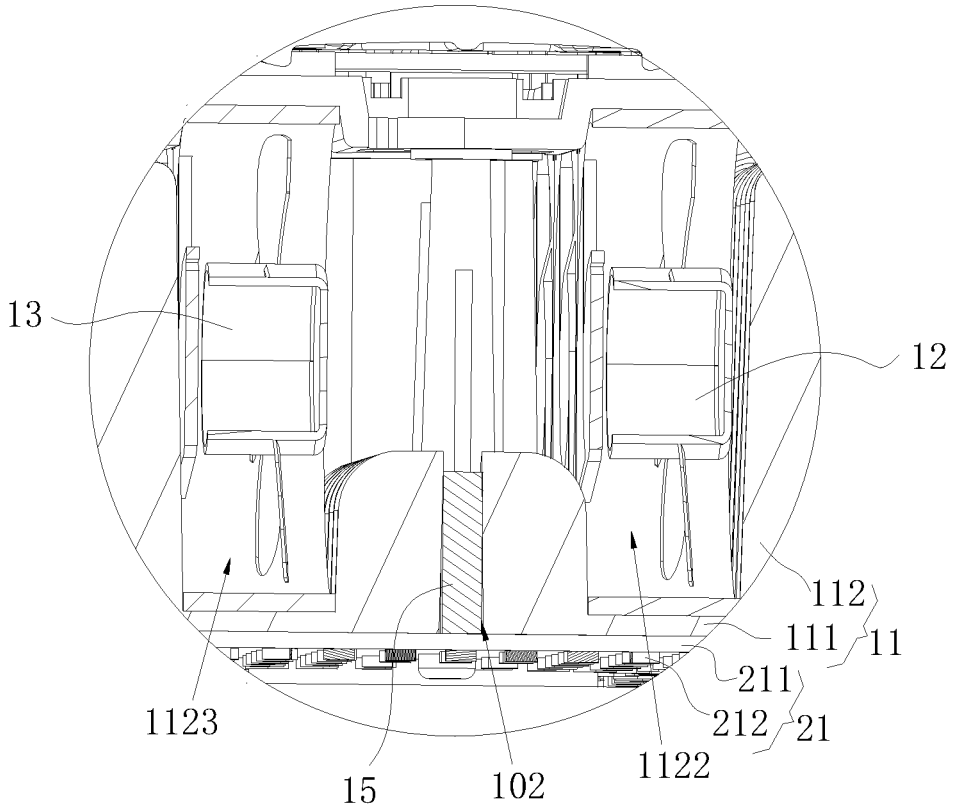
FIG. 6 is the part sectional view of heat dissipation device provided in the embodiment of the present invention.

As shown in FIGS. 4 to 6, the heat dissipation device 10 includes main radiator 911; the main radiator 911 comprises heat dissipation body 111 and heat dissipation mechanism 112; the heat dissipation body 111 has a mounting surface and a junction surface. The mounting surface is used to install the heat source surface of the said electric light source, namely the lamp panel of LED lamp beads; the heat dissipation mechanism 112 includes a plurality of radiating fins mounted on the junction surface.

(1) In order to obtain larger heat dissipation area and arrange more LED lamp beads, the radiator fan 12 is set to horizontal blowing, and the wind direction is limited to the rightward blowing, so as to better reflect the relationship between the wind direction and the installation position of the radiator fan 12.

(2) In order to save the installation volume of the heat dissipation mechanism 112 in the electric light source 9, the radiator fan 12 is arranged in the avoidance space between the radiating fins instead of at the top of the radiating fin. This design can also increase the height of the radiating fin to a certain extent and improve the heat dissipation performance.

(3) In order to prevent the air blown out by the radiator fan 12 from interfering with each other, the radiating fin is designed to extend substantially in the left-right direction, thereby forming a plurality of heat dissipation channels 1121 extending in the left-right direction. The radiator fan 12 is designed in the heat dissipation channel 902.

Figure 3:
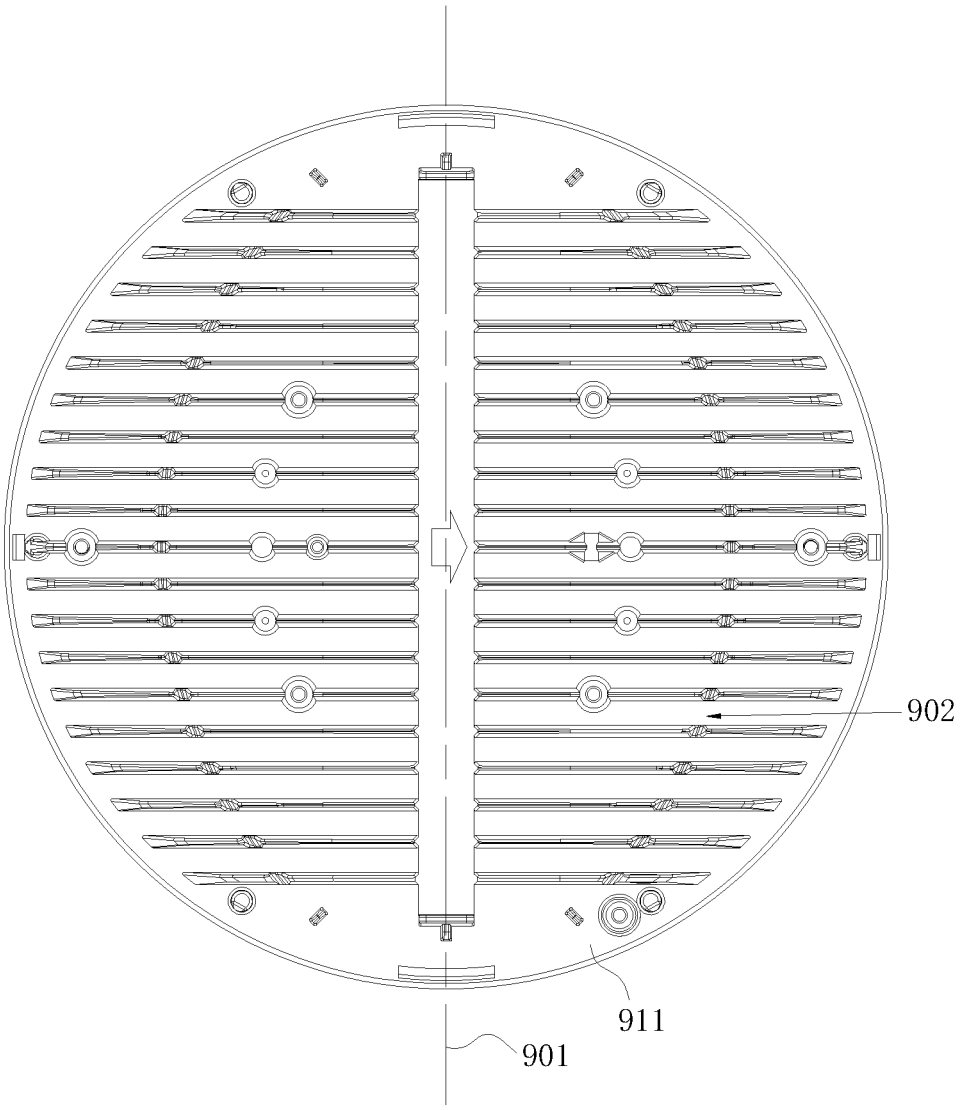
FIG. 3 is the top view of main radiator when the radiator fan is installed in the center line.

Based on the design of (1) (2) (3), we usually design four radiator fans 12 in the middle of the main radiator 911, that is, on the center line 901 as shown in FIG. 3. The center line 901 is a virtual reference line on the junction surface. We assume that the center line 901 is perpendicular to the extension direction of the radiating fin, and that the main radiator 911 on the left and right sides of the center line has the same heat dissipation capacity in the natural state. That is to say, if the main radiator 911 is a left and right symmetrical structure, then the center line 901 is a straight line; if the main radiator 911 is not a left and right symmetrical structure, then the center line 901 may be a curve. The natural state refers to the ambient temperature around the main radiator 911, the airflow direction and other external heat dissipation conditions are the same.

Based on the above scheme, when the power of the electric light source 9 is 350 W, the lamp beads are uniformly distributed, the main radiator is made of a common aluminum alloy (ADC12), the experiment shows that the temperature of the main radiator 111 on the right side of the center line 901 is higher than the temperature on the left side when designing four radiator fans 12 on the center line 901. This conclusion is inconsistent with the result of subjective speculation. It is the usual understanding that: Because the radiator fan 12 blows to the right, the wind speed on the right side of the center line 901 is faster and can take away the heat faster, and the heat dissipation performance on the right side of the center line 901 will be better, so that the temperature of the main radiator 111 on the right side of the center line 901 will be lower. It is clear that the experimental results prove that this conventional understanding is wrong.

Through the heat dissipation simulation, we find that the heat dissipation process is as follows: The outlet direction of the radiator fan 12 is to blow to the right, and the air temperature of each heat dissipation channel 902 will gradually increase from left to right. Although the airflow rate on the right side of the radiator fan 12 is faster, the temperature of the main radiator 911 on the right side of the radiator fan 12 is still higher than the temperature of the main radiator 911 on the left side of the radiator fan 12. This also indirectly indicates that the effect of the temperature difference between the air and the surface of main radiator 911 on the heat dissipation performance is greater than the effect of the airflow rate on the heat dissipation performance in the heat dissipation process of the present scheme.

Based on the above test and analysis, as shown in FIG. 2, when the radiator fan 12 is set on the center line 901, the temperature of the right main radiator 911 will be higher than that of the left main radiator 911. Therefore, we can install the radiator fan 12 on the right side of the center line 901, as shown in FIG. 4. The temperature of the left main radiator 11 will be properly increased, and the temperature of the right main radiator 11 will decrease appropriately, so that the temperature of each area of the main radiator 11 will be more uniform, and the maximum temperature of the main radiator 11 can be further reduced. That is to say, the radiator fan 12 is set in the first avoidance space 1122 on the right side of the center line 901, which can obtain better heat dissipation performance.

According to the verification of the above embodiment, when the four heat radiator fans 12 work at the same time, the heat dissipation guarantee can be provided for 350 W electric light source, but when one or more radiator fans 12 fail, the temperature of LED lamp beads will be increased, and the service life of the electric light source will be further influenced. So, we have a second avoidance space 1123 on the main radiator 11 on the left side of the radiator fan 12, and a standby fan 13 is provided in the second avoidance space 1123. When the radiator fan 12 stops working, the standby fan 13 can replace the radiator fan 12. In the embodiment, there are 4 standby fans 13 in the corresponding heat dissipation channels together with 4 radiator fans 12.

As shown in FIG. 4, the insect, leaf or other sundries may fly into the air inlet channel on the left side of the radiator fan 12 or the air outlet channel on the right side of the standby fan 13, thereby possibly affecting the normal operation of the radiator fan 12 or the standby fan 13. So, there is also a protective net 14 on the heat dissipation channel 1121. The protective net 14 can be arranged in the air inlet channel or/and the air outlet channel.

Figure 7:
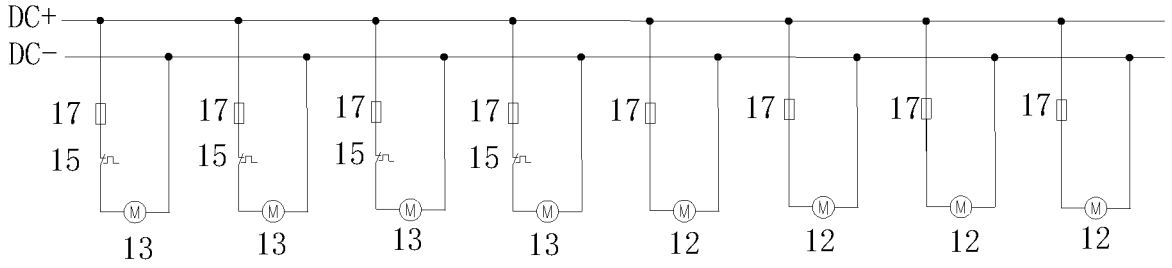
FIG. 7 is the circuit diagram of radiator fan and standby fan provided in the embodiment of the present invention.
Figure 8:
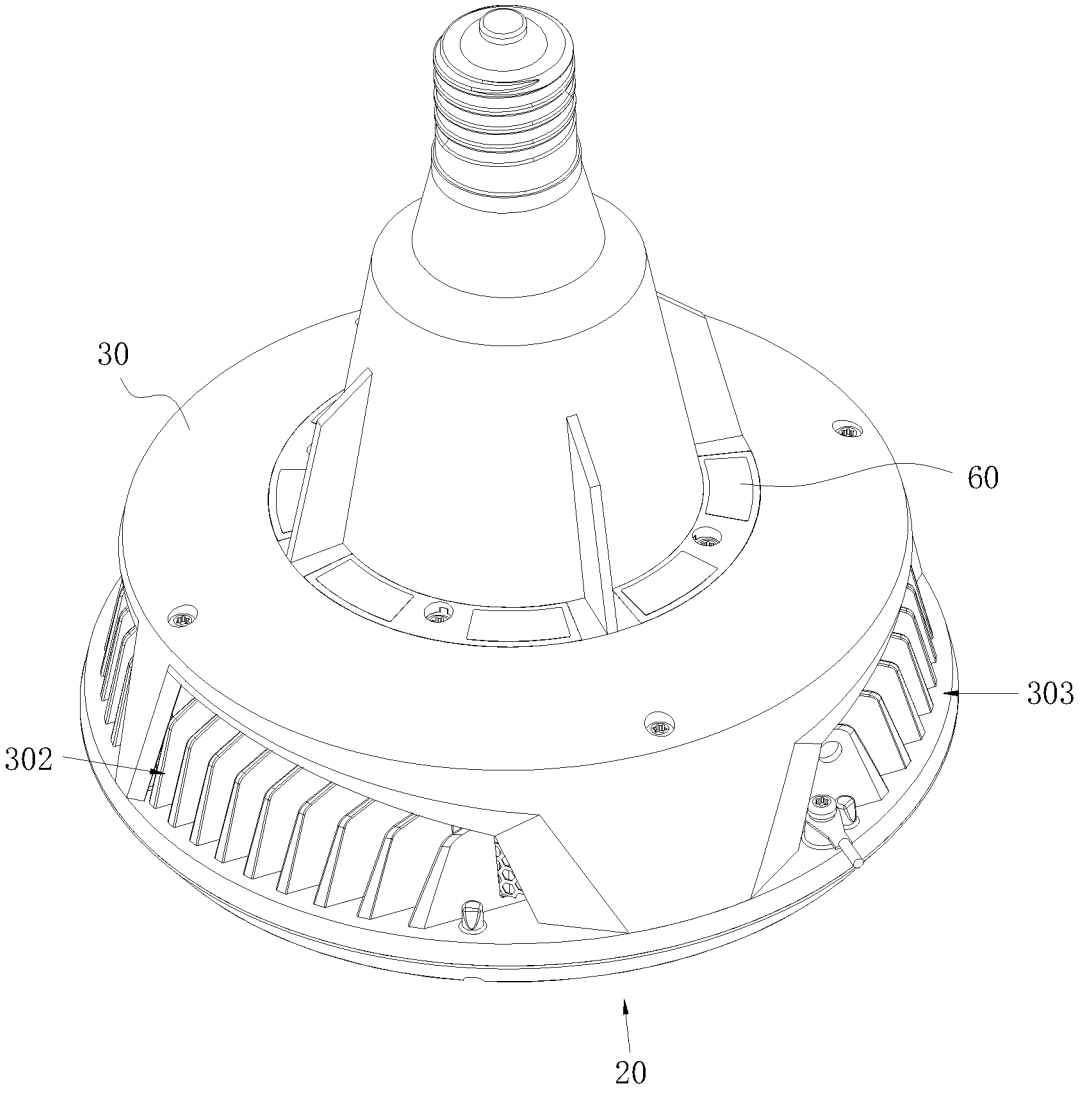
FIG. 8 is the stereoscopic structure diagram of high-power electric light source provided in the embodiment of the present invention.

As shown in FIGS. 4 and 7, 4 radiator fans 12 can be connected in parallel to obtain power supply from the same power supply terminal. The power supply terminal of the present embodiment provides a direct current of 12V voltage, which can also be supplied to the four standby fans 13 in a parallel manner. In addition, considering that the radiator fan 12 or the standby fan 13 may fail, in order to avoid the short circuit of one or more radiator fans 12 or standby fans 13, other corresponding radiator fan 12 or standby fan 13 does not function properly, so that a fuse 17 is connected serially on the input line of each radiator fan 12 or standby fan 13, thereby improving the stability of the system.

As shown in FIGS. 4 to 7, the working state of the radiator fan 12 is to work all the time after the power supply terminal is turned on, but the standby fan 13 may not need to work all the time, and the standby fan 13 can only start working when the heat dissipation capacity of the heat dissipation device 10 cannot meet the heat dissipation needs of the high-power electric light source. Such a further scheme may be that four more first temperature control switches 15 may be arranged in the heat dissipation channel 1121, and the first temperature control switches 15 may be connected in series to the input line of the standby fan 13. When the radiator fan 12 fails and stops working or the ambient temperature around the heat dissipation device 10 rises, the temperature of the corresponding heat dissipation channel 1121 will rise. At this time, the first temperature control switch 15 detects that the temperature of the heat dissipation channel 1121 is higher than the set value, and the first temperature control switch 15 is turned on to start the standby fan 13 within the corresponding heat dissipation channel 1121, thereby improving the heat dissipation performance of the system; when the fault is removed, the temperature of the corresponding heat dissipation channel 1121 is lower than the set value, the first temperature control switch 15 will automatically return to the turn-off state, and the corresponding standby fan 13 will stop working.

As shown in FIG. 6, the junction surface of the main radiator 11 is provided with a connection slot 102 that the slot width of the slot bottom is larger than that of the slot opening; the first temperature control switch 15 is installed from the slot bottom of the connection slot 102 to the slot opening, and the connection line of the first temperature control switch 15 is pierced from the slot opening. Since the slot is small, the first temperature control switch 15 can be limited to move upward. The heat source surface of the high-power electric light source (that is, the lamp panel) is used to limit the downward movement of the first temperature control switch 15. The first temperature control switch 15 can be quickly installed through the design of the connection slot 102.

As shown in FIGS. 8 to 12, the high-power electric light source includes an electric light source shell 30, a driving power supply 41, a luminescent device 20, and a heat dissipation device 10, wherein the electric light source shell 30 is connected to the heat dissipation device 10 and forms a heat dissipation cavity together with the main radiator 11. The electric light source shell 30 is provided with an inlet air hole 302 and an outlet air hole 303 at the left and right ends of the heat dissipation channel 1121 to dissipate the heat of the high-power electric light source. The luminescent device 10 includes a bottom luminous module 21 and a bottom lamp cover 22, and the bottom luminous module 21 includes a bottom lamp panel 211 and a lamp bead. The lamp bead is LED lamp bead, and the bottom lamp panel 211 is mounted on the mounting surface of the main radiator 11. The driving power supply 41 is electrically connected to the bottom lamp panel 211 and supplies power to the lamp beads.

Figure 9:
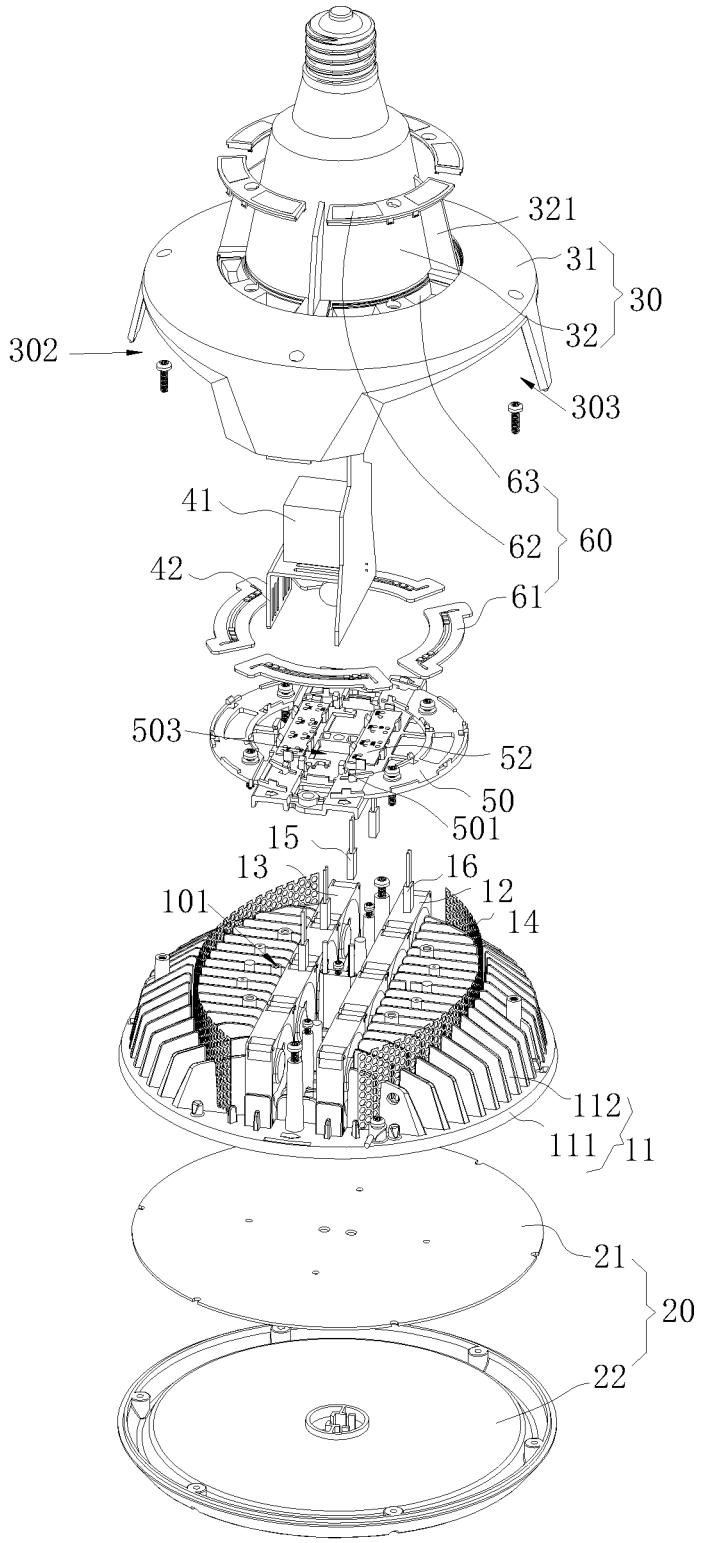
FIG. 9 is the explosive view from one perspective of high-power electric light source provided in the embodiment of the present invention.
Figure 10:
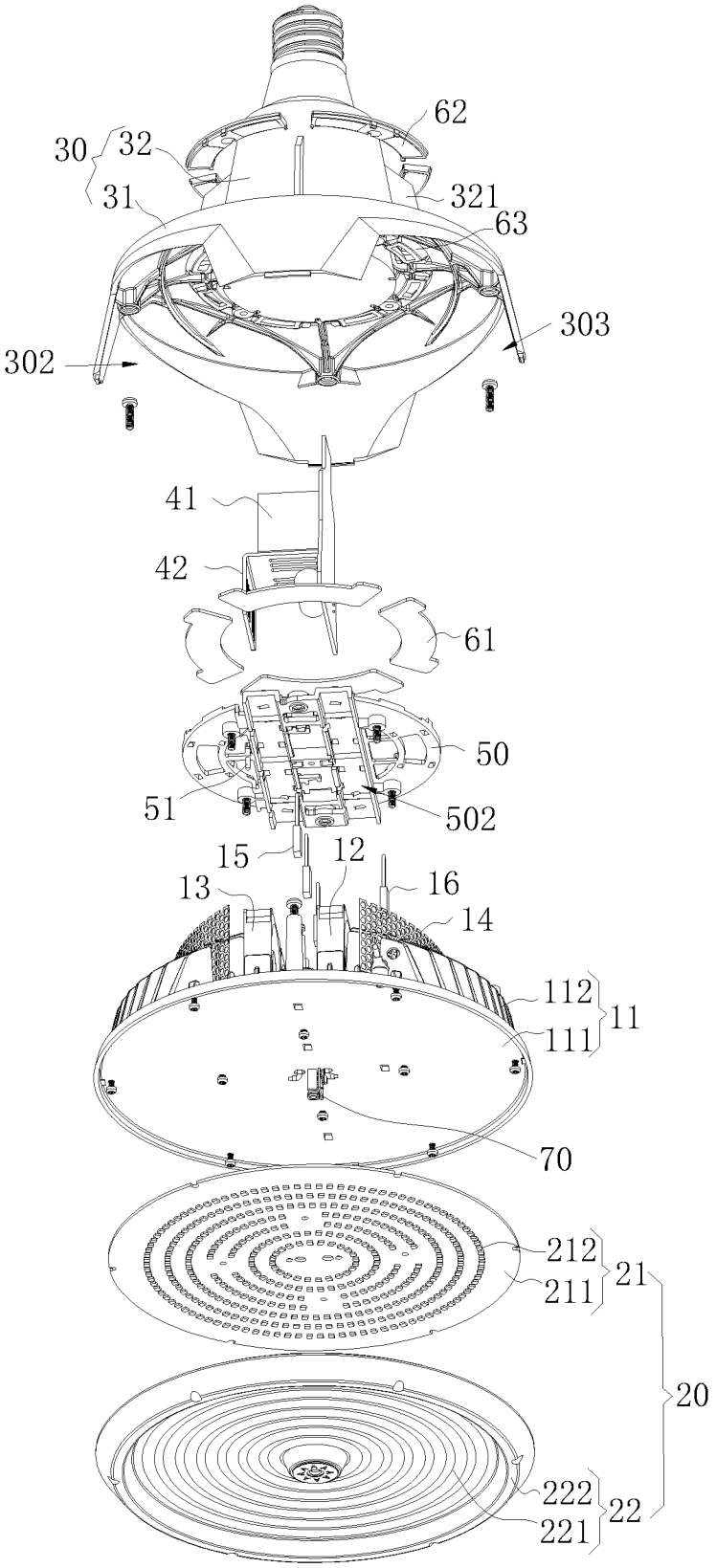
FIG. 10 is the explosive view from another perspective of high-power electric light source provided in the embodiment of the present invention.

As shown in FIGS. 9 and 10, in order to prevent the wrong use of the high-power electric light source in a place where the ambient temperature is too high or the air fluidity is poor, the driving power supply 41 is also electrically connected to the second temperature control switch 16, thereby protecting the entire high-power electric light source at a reasonable temperature. The second temperature control switch 16 is arranged in the area with the highest temperature of the heat dissipation device 10, that is, on the main radiator 11 on the right side of the center line 901. The second temperature control switch 16 is installed in the same way as the first temperature control switch 15 through the connection slot 102. When the second temperature control switch 16 detects that the temperature of the connection slot 102 is higher than the set value, the driving power supply 41 automatically reduces the working power of the high-power electric light source, so that the components of the high-power electric light source work at a lower temperature. When the high temperature signal of the connection slot 102 is removed, the driving power supply 41 is automatically restored to the conventional power of the high-power electric light source.

Figure 12:
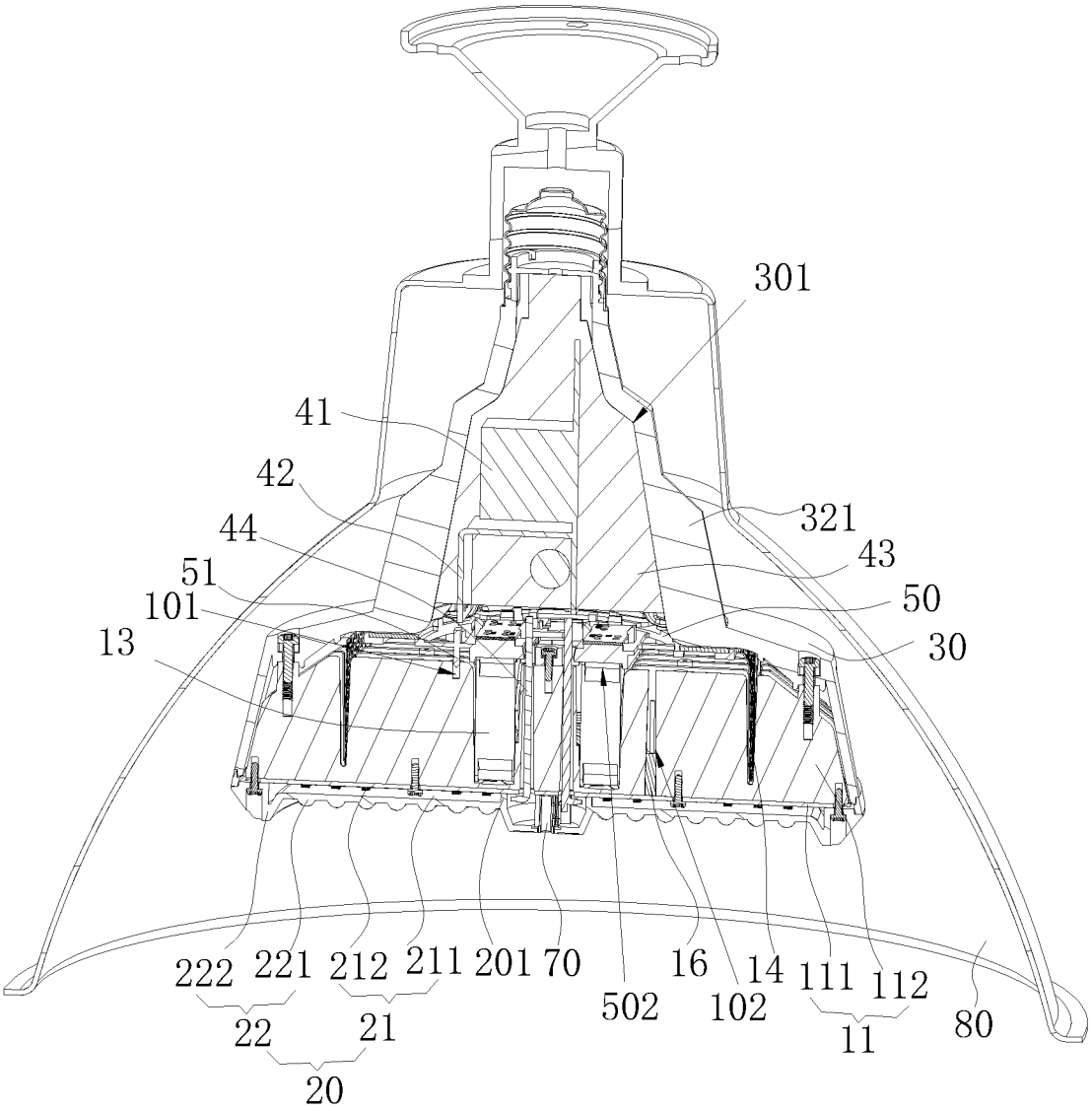
FIG. 12 is the sectional view of high-power electric light source provided in the embodiment of the present invention.

As shown in FIGS. 10 and 12, in order to better apply a high-power electric light source to a conventional Hight Bay lamp 80 mounted at a high place, it is necessary to reduce the luminous angle of the high-power electric light source to some extent, so that the bottom lamp cover 22 is also designed with a lens structure 221. The lens structure 221 may reduce the light emission angle of the bottom luminous module 21.

As shown in FIGS. 10 and 12, for 350 W super high-power electric light source, it is inevitable that their lighting performance needs to be tested in product research and development, production, sales or installation and application. In this case, the high-brightness light easily causes the human eye to be uncomfortable, so a boss 222, which is circumferentially surrounded by the lens structure 221, is also provided on the bottom lamp cover 22. In this way, the boss 222 can support the downward placement of the high-power electric light source, thus avoiding the harm of the high brightness light to the human eye during the lighting process of the high-power electric light source. The horizontal position of the lower surface of the boss 222 is lower than that of the lower surface of the lens structure 221, so that the luminous quality of the luminous area of the bottom lamp cover 22 can be protected from wear.

As shown in FIG. 12, the electric light source shell 30 has a base part connected to the main radiator 11 and a head connected to the base part and extending upward, and the outer wall of the head is also provided with an outward protruding reinforced rib 321. The reinforced rib 321 can improve the strength of the electric light source shell 30, and can also enable the electric light source shell 30 does not cling to the inner wall of the traditional Hight Bay lamp in the process that the high-power electric light source is installed in the traditional Hight Bay lamp 80 so as to obtain a large heat dissipation space.

For the driving power supply 41, it can be designed outside the high-power electric light source or inside the high-power electric light source. When the driving power supply 41 is designed inside the high-power electric light source, the installation and application of the high-power electric light source will be very convenient, but the heat dissipation requirement of the system is higher. Therefore, we further improve its heat dissipation based on the above scheme.

As shown in FIG. 12, the electric light source shell 30 has an accommodating chamber 301 and the driving power supply 41 is installed in the accommodating chamber 301, and the pouring sealant 43 for heat conduction is sealed around the driving power supply 41 in the accommodating chamber 301, thereby improving the heat dissipation performance of the driving power supply 41. At this point, the driving power supply 41 may have two outputs, including a constant current output for driving the luminescent device and a constant voltage output for driving the radiator fan 12. The constant voltage output can also power the standby fan 13.

In addition, since the driving power supply 41 has a different working efficiency, the driving power supply 41 having a low power supply efficiency has a large amount of heat. At this time, the electric light source shell 30 is a conventional plastic material, which may cause the driving power supply 41 difficult to dissipate heat. So, as shown in FIGS. 9, 10 and 12, we can have one or more power radiators 42 on the driving power supply 41, and the power radiator 42 extends from the pouring sealant 43 to the heat dissipation cavity, and takes away the heat of the driving power supply 41 through the radiator fan 12 or the standby fan 13.

Figure 11:
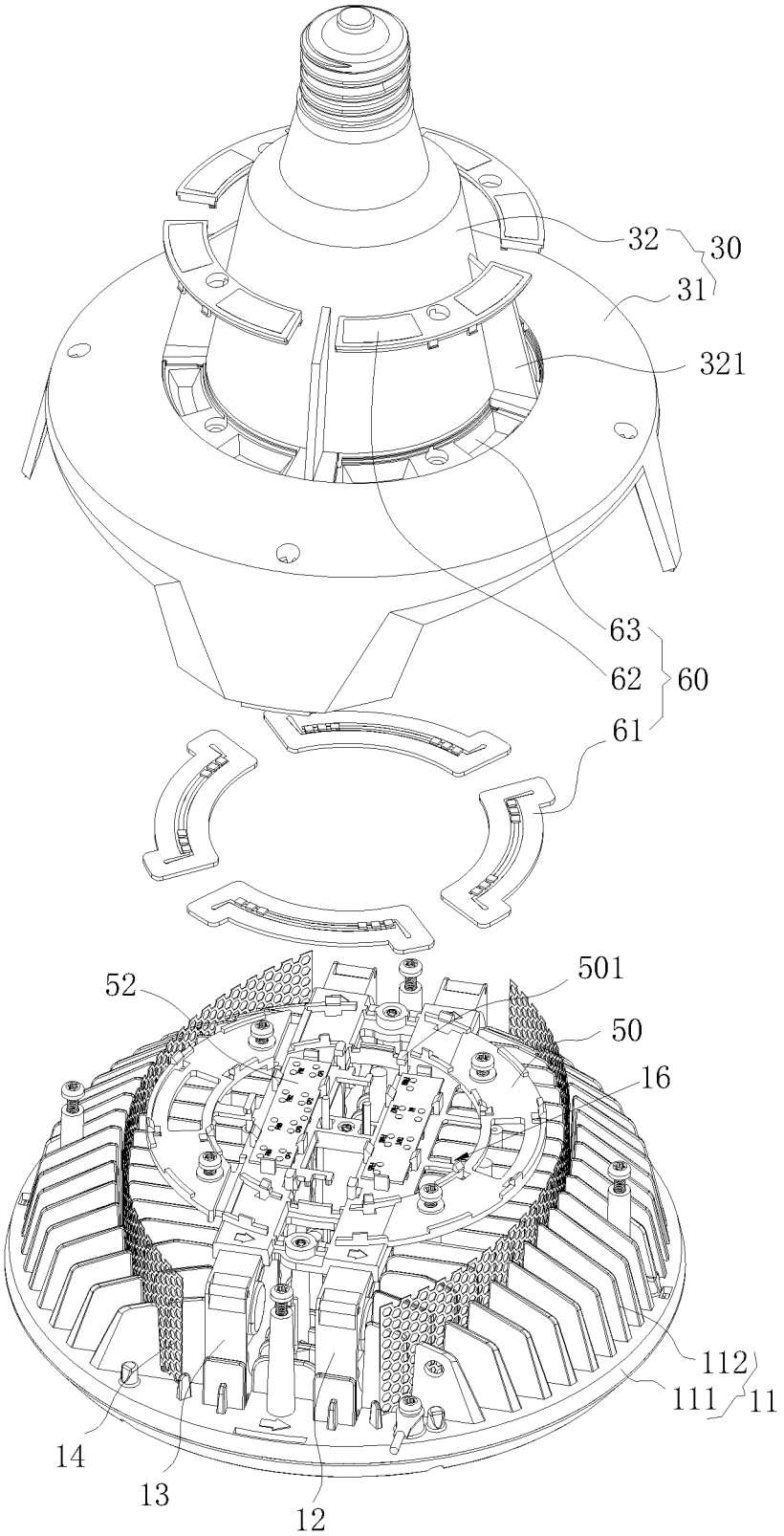
FIG. 11 is the part explosive view of high-power electric light source provided in the embodiment of the present invention.

As shown in FIG. 11, further, in order to simplify the assembly process of the high-power electric light source, a fixing plate 50 is provided between the main radiator 11 and the electric light source shell 30, or may be mounted on the heat dissipation device 10 or the electric light source shell 30. The fixing plate 50 may be a multi-functional part.

As shown in FIGS. 10 and 12, the lower side of the fixing plate 50 may be provided with a fixing slot 502 suitable for the radiator fan 12 and the standby fan 13. The radiator fan 12 and the standby fan 13 are inserted inside the said fixing slot 502, which can simplify the installation process of the radiator fan 12 and the standby fan 13.

As shown in FIGS. 9 and 12, the lower side of the fixing plate 50 may also be provided with a positioning column 51 extending downward, the main radiator 11 is provided with a positioning hole 101 suitable for the positioning column 51, and the positioning column 51 is inserted in the positioning hole 101. In this way, positioning and installation can be realized quickly, and the installation direction of the fixing plate 51 and the main radiator 11 can be limited to avoid confusion in the assembly direction.

As shown in FIG. 9, the fixing plate 50 is provided with a plurality of through holes 503 which are connected up and down and are used for radiating or threading to facilitate the internal wiring and heat dissipation of high-power electric light source.

As shown in FIG. 11, in order to simplify the internal wiring of the high-power electric light source, one or more wiring boards 52 can also be added to the high-power electric light source; the wiring board 52 may be mounted on the fixing plate 50 by a fixing structure, such as a snap connection. The wiring board 52 serves to electrically connect radiator fan 12, driving power supply 41, fuse 17 or one or more first temperature control switches 15.

As shown in FIGS. 9 and 11, one or more winding columns 501 may also be protruding on the fixing plate 50, and the winding column 501 is bent in the hook shape to facilitate the connection of conductors 44 in different directions on the wiring board 52.

As shown in FIGS. 9 and 10, in order to make the luminous effect of the high-power electric light source closer to the traditional light source, the back luminous module 60 is also arranged on the high-power electric light source. The back luminous module 60 comprises a back-lamp cover 62, a back-lamp panel 61 for emitting light towards the upper part and arranged on the fixing plate 50 and a reflecting cup structure 63 arranged on the electric light source shell 30. The back-lamp cover 62 is fixed on the top of the said reflecting cup structure 63. This design can simplify the structure of the back luminous module 60 and improve the production efficiency of the high-power electric light source.

As shown in FIGS. 10 and 12, in order to achieve the intelligence of high-power electric light source, a mounting slot is provided on bottom lamp cover 62. The mounting slot is equipped with a control socket 70 that electrically connect to the driving power supply 41. The control socket 70 is provided with a control interface which is used for receiving 0-10V, PWM or resistance signal to realize the dimming of the luminescent device 20.

The above are only the preferred embodiments of the present invention, and are not intended to limit the present invention. Any modifications, equivalent substitutions and improvements made within the spirits and principles of the present invention shall be included in the protection scope of the present invention.

What is claimed is:

1. A heat dissipation device used for the heat dissipation of an electric light source, comprising: a main radiator comprising a heat dissipation body and a heat dissipation mechanism, the heat dissipation body has a mounting surface and a junction surface, the mounting surface is used to mount a heat source surface of the electric light source, the heat dissipation mechanism comprising a plurality of radiating fins arranged on the junction surface which extends substantially in the left-right direction at intervals and collectively forms a heat dissipation channel extending in the left-right direction, the heat dissipation mechanism is provided with a first avoidance space, in which the junction surface has a center line perpendicular to an extension direction of the radiating fin, and left and right parts of the main radiator bounded by the center line have a same heat dissipation capacity in a natural state, and the first avoidance space is arranged on the right side of the center line; at least one radiator fan is provided that is installed in the first avoidance space and is used for radiating the airflow flowing from left to right in the heat dissipation channel.

2. The heat dissipation device as in claim 1, where in the heat dissipation mechanism is provided with a second avoidance space;

the heat dissipation device further comprises at least one standby fan arranged in the second avoidance space, the standby fan is used for radiating airflow flowing from left to right in the heat dissipation channel, the second avoidance space is positioned on the left side of the first avoidance space.

3. The heat dissipation device as in claim 2, where in the heat dissipation device further comprises one or more first temperature control switches, the first temperature control switch is installed in the heat dissipation channel, and is connected in series to the input line of the standby fan, the first temperature control switch is independently controls the standby fan in series with the switch and switching the standby fan between the on and off states.

4. The heat dissipation device as in claim 3, wherein the junction surface is provided with a connection slot where a slot width of a slot bottom is larger than that of a slot opening, the connection slot is used for limiting the upward movement of the first temperature control switch, and the heat source surface of the electric light source is used for limiting the downward movement of the first temperature control switch.

5. The heat dissipation device as in claim 1, where in the heat dissipation device further comprises a protective net inserted in the heat dissipation channel, the heat dissipation channel is divided into an air inlet channel on the left side and an air outlet channel on the right side by the first avoidance space, and the protective net is arranged in the air inlet channel or/and the air outlet channel.

6. The heat dissipation device as in claim 3, further comprising a number of the radiator fans that are connected in parallel, and the heat dissipation device as claimed also comprises a plurality of fuses that are connected in series to the input line of the radiator fan.

7. A high-power electric light source comprising: an electric light source shell;

a driving power supply; a luminescent device;

a heat dissipation device comprising a main radiator comprising a heat dissipation body and a heat dissipation mechanism, the heat dissipation body has a mounting surface and a junction surface, the mounting surface is used to mount a heat source surface of the electric light source, the heat dissipation mechanism comprising a plurality of radiating fins arranged on the junction surface which extends substantially in the left-right direction at intervals and collectively forms a heat dissipation channel extending in the left-right direction, the heat dissipation mechanism is provided with a first avoidance space, in which the junction surface has a center line perpendicular to an extension direction of the radiating fin, and left and right parts of the main radiator bounded by the center line have a same heat dissipation capacity in a natural state, and the first avoidance space is arranged on the right side of the center line; at least one radiator fan is provided that is installed in the first avoidance space and is used for radiating the airflow flowing from left to right in the heat dissipation channel; and wherein the electric light source shell is connected to the heat dissipation device and forms a heat dissipation cavity together with the main radiator, the electric light source shell is provided with an inlet air hole and an outlet air hole at left and right ends of the heat dissipation channel; the luminescent device comprises a bottom luminous module and a bottom lamp cover; the bottom luminous module is installed on the mounting surface and the bottom lamp cover is installed at the bottom of the main radiator.

8. The high-power electric light source as in claim 7, wherein the heat dissipation device further comprises a second temperature control switch arranged on the main radiator and on the right side of the center line, the second temperature control switch electrically connected to the driving power supply and is used for controlling the output power of the driving power supply.

9. The high-power electric light source as in claim 7, wherein the bottom luminous module comprises a bottom lamp panel and a lamp bead, and the bottom lamp cover comprises a lens structure for reducing the luminous angle of the bottom luminous module.

10. The high-power electric light source as in claim 9, wherein the bottom lamp cover further comprises a boss which is circumferentially arranged around the lens structure, and a horizontal position of a lower surface of the boss is lower than that of a lower surface of the lens structure.

11. The high-power electric light source as in claim 7, wherein the electric light source shell has a base part connected to the main radiator and a head connected to the base part and extending upward, and the high-power electric light source further comprises a reinforced rib connected to the head and protruding outward on the outer wall of the head.

12. The high-power electric light source as in claim 7, wherein the electric light source shell has an accommodating chamber, and the driving power supply is installed in the accommodating chamber, the accommodating chamber is filled with pouring sealant for heat conduction, the driving power supply is electrically connected to the luminescent device and the radiator fan, or/and the driving power supply is electrically connected to the standby fan.

13. The high-power electric light source as in claim 12, wherein the high-power electric light source further comprises at least a power radiator connected to the pouring sealant, and the power radiator extends the pouring sealant and extends to the heat dissipation cavity.

14. The high-power electric light source as in claim 12, wherein the high-power electric light source further comprises a fixing plate that is provided between the main radiator and the electric light source shell, and installed on the heat dissipation device or the electric light source shell.

15. The high-power electric light source as in claim 14, wherein a lower side of the fixing plate is provided with a fixing slot suitable for the radiator fan, and the radiator fan is arranged in the fixing slot.

16. The high-power electric light source as in claim 14, wherein the high-power electric light source further comprises a positioning column extending downward arranged on the lower side of the fixing plate, the main radiator is provided with a positioning hole suitable for the positioning column, and the positioning column is inserted in the positioning hole.

17. The high-power electric light source as in claim 14, wherein the fixing plate is provided with a plurality of through holes which are connected up and down and used for radiating or threading.

18. The high-power electric light source as in claim 14, wherein the high-power electric light source further comprises at least one wiring board mounted on the fixing plate for electrically connecting the radiator fan, the driving power supply, the fuse, or one or more of the first temperature control switches.

19. The high-power electric light source as in claim 14, wherein a winding column in a curved hook shape is convexly arranged on the fixing plate.

20. The high-power electric light source as in claim 14, wherein the high-power electric light source further comprises a back luminous module, the back luminous module comprises a back-lamp cover, a back-lamp panel for emitting light towards the upper part and arranged on the fixing plate and a reflecting cup structure arranged on the electric light source shell, and the back lamp cover is fixed on the top of the reflecting cup structure.

21. The high-power electric light source as in claim 14, wherein the high-power electric light source further comprises a control socket which is connected to the bottom lamp cover and is electrically connected to the driving power supply, the control socket is provided with a control interface which is used for receiving 0-10V, PWM or resistance signal to realize the dimming of the luminescent device.

* * * * *